United States Patent [19]

Hill

[11] 4,006,828

[45] Feb. 8, 1977

[54] APPARATUS FOR ALIGNING THE ENDS OF PRODUCT LENGTHS

[75] Inventor: William J. Hill, Holden, Mass.

[73] Assignee: Morgan Construction Company, Worcester, Mass.

[22] Filed: Aug. 11, 1975

[21] Appl. No.: 603,368

[52] U.S. Cl. ..... 214/1 P

[51] Int. Cl.[2] ..... B21B 39/20

[58] Field of Search ..... 214/1 P, 1 PA, 1 PB, 214/1 R; 198/29, 30, 29 X, 267, 286, 282, 283, 284; 294/67 BB, 81 R

[56] References Cited

UNITED STATES PATENTS

| | | | |
|---|---|---|---|
| 3,419,159 | 12/1968 | Schaller et al. | 214/1 P |
| 3,823,812 | 7/1974 | Sieurin | 214/1 P X |

*Primary Examiner*—Trygve M. Blix
*Assistant Examiner*—Douglas C. Butler
*Attorney, Agent, or Firm*—Thompson, Birch, Gauthier & Samuels

[57] ABSTRACT

An apparatus for aligning the ends of product lengths being delivered laterally into an alignment zone. The apparatus employs a plurality of pairs of alignment heads which are arranged to reciprocally contact and align the ends of product lengths as they arrive in the alignment zone. The alignment heads are mounted for movement on a stationary rail spanning the length of the alignment zone. The rail is supported on a frame which also carries a pair of reciprocally driven draw bars. Remotely operable devices are employed to releasably connect the alignment heads to the draw bars and to adjust the spacing between cooperating pairs of alignment heads.

10 Claims, 15 Drawing Figures

APPARATUS FOR ALIGNING THE ENDS OF PRODUCT LENGTHS

BACKGROUND OF THE INVENTION

This invention relates generally to the art of material handling, and is concerned in particular with an apparatus for aligning the ends of product lengths.

The invention is particularly useful in, although not limited in application to bar mills where the rolled products (for example, angles, flats, rounds, etc.) are subdivided into shorter product lengths which are then assembled and bound into tightly packed bundles. Where bundles of this type are being produced, it is important to avoid having axially misaligned product lengths, the ends of which protrude from the ends of the bundles. Such protruding ends spoil the appearance of the bundles, create a safety hazard, and are likely to be bent or distorted during subsequent handling. Moreover, it is important to have the ends of the bundled product lengths properly aligned in the event that the bundles are to be subsequently subdivided by band sawing or other means.

Prior to the present invention, it was thought adequate to employ "single mode" end alignment devices having only one pair of cooperating alignment heads. In such arrangements, the alignment heads are reciprocally driven towards and away from each other, with the distance between the heads being adjusted manually so that the ends of cut product lengths passing therebetween are properly aligned prior to the bundling operation. An example of this type of equipment is described in my copending application Ser. No. 346,460 filed Mar. 30, 1973, now U.S. Pat. No. 3,902,586.

It has now been determined, however, that a single mode end alignment apparatus may not have sufficient capacity to handle the output of higher speed modern mills, particularly where the product is being subdivided into a wide range of product lengths. Under these circumstances, an end alignment apparatus employing a plurality of pairs of alignment heads adaptable to either single or multi-mode operation would be preferable. Such an apparatus could be operated with one pair of alignment heads in a single mode operation to handle longer product lengths, for example those in the range of 30 to 60 feet in length. The same apparatus could employ two pairs of alignment heads in a dual mode operation to simultaneously handle shorter product lengths under 30 feet in length. Additional pairs of alignment heads could be added under circumstances requiring a still greater alignment capacity.

Accordingly, a general object of the present invention is the provision of an end alignment apparatus having a plurality of pairs of cooperating end alignment heads which can be operated in either a single or multi-mode arrangement.

Another object of the present invention is to provide an end alignment apparatus having novel and improved means for quickly and efficiently adjusting the distance between cooperating pairs of alignment heads.

A further object of the present invention is the provision of an end alignment apparatus having a plurality of cooperating pairs of alignment heads with a remote positioning system for converting the apparatus to either a single or multi-mode operation, and also to achieve rapid and precise positioning of the alignment heads.

Another object of the present invention is the provision of means to protect equipment components from damage in the event that an overlength product is allowed to pass between any given pair of cooperating alignment heads.

SUMMARY OF THE INVENTION

According to the present invention, there is provided an improved end alignment apparatus, which in a preferred embodiment to be hereinafter described in greater detail, comprises a stationary support frame located proximate to an alignment zone into which cut product lengths are delivered laterally. An elongated rail is fixed to the support frame. The rail extends in a direction parallel to the length of the alignment zone. A plurality of pairs of "first" and "second" alignment heads are carried on the rail for movement along the length thereof. Each alignment head has a product contacting face which extends into the alignment zone. Two draw bars are carried on the support frame. A drive means is employed to axially reciprocate the draw bars simultaneously in opposite directions relative to the support frame. Locking means are employed to connect the alignment heads to the draw bars. The locking means associated with the "first" alignment heads provide a releasable engagement with one of the draw bars, while the locking means associated with the "second" alignment heads provide a releasable engagement with the other draw bar. The locking means are remotely operable, and a remotely operable positioning means is employed to adjust the distance between cooperating pairs of alignment heads, as well as to convert the apparatus to either single or multi-mode operation.

BRIEF DESCRIPTION OF THE DRAWINGS

An embodiment of the invention will now be described by way of example only, with reference to the accompanying drawings wherein.

DESCRIPTION OF PREFERRED EMBODIMENT

Figure 1:
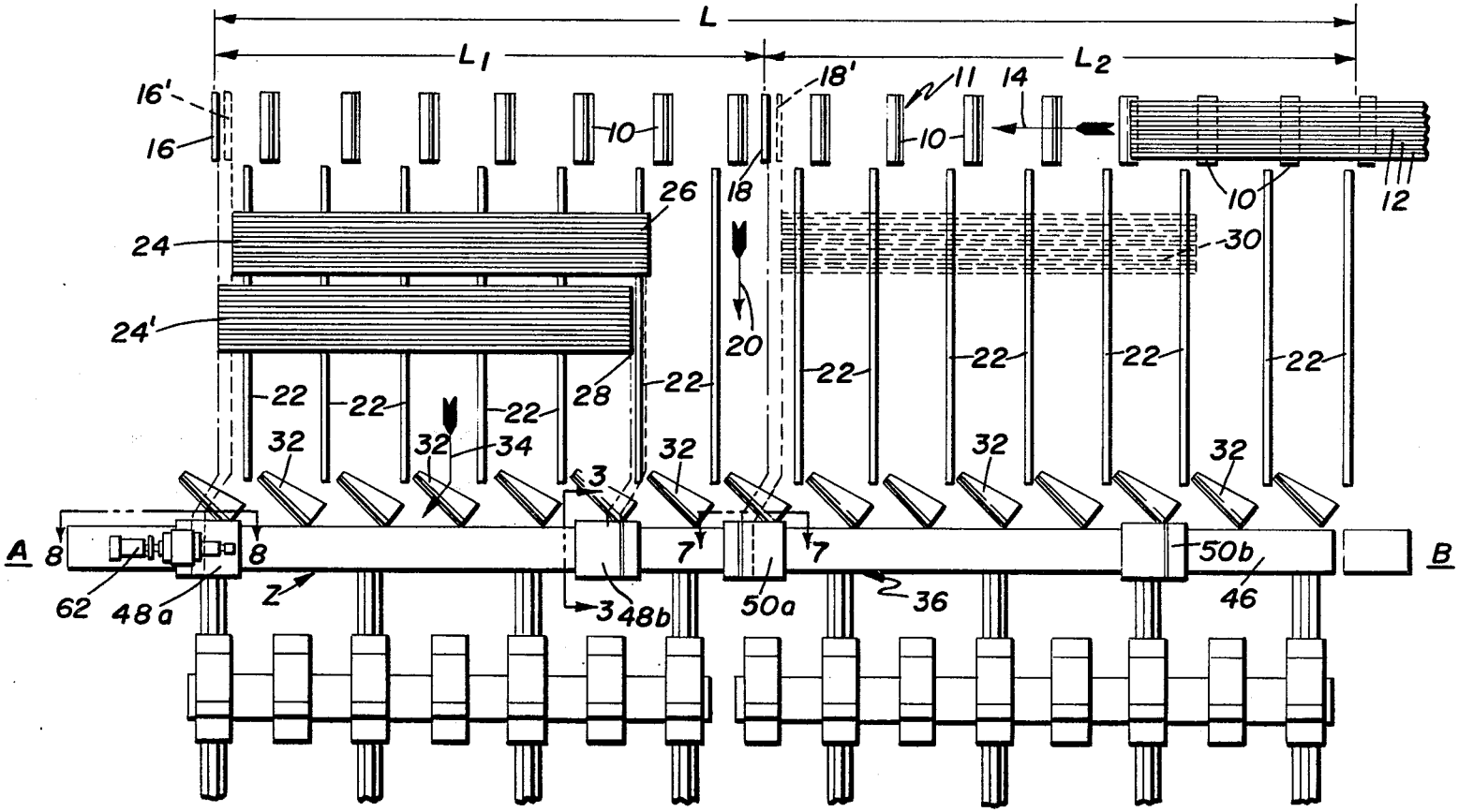
FIG. 1 is a schematic plan view showing the location of the end alignment device of the present invention in relation to other associated product handling equipment in a bar mill.

Referring initially to FIG. 1, the reference numerals 10 indicate the aligned driven rollers of a roller table 11 which receives batches of product lengths 12 cut to length by an upstream shear (not shown). The cut product lengths travel in the direction of arrow 14 until they engage either stop 16 or stop 18. Stop 18 is capable of being lowered beneath the conveyor surface defined by rollers 10 when stop 16 is being employed. After coming to rest against either stop 16 or stop 18, the batches of product lengths are shifted laterally by conventional means (not shown) in the direction of arrow 20 onto delivery chains 22. The ideal location for a batch of product lengths is depicted at 24, where the upstream end of the batch overlaps a delivery chain as at 26. If the length of cut results in the upstream end of the batch being short of a delivery chain, as at 28, then there is a danger that the bar ends may become entangled with the chains 22 or their sprockets. To avoid this problem, the table stop 16 can be shifted a short distance to a position shown in dotted at 16′, thereby insuring that the upstream end of each batch is clear of or fully supported by the delivery chains. In like manner, table stop 18 is capable of being shifted to 18′.

When handling longer product lengths, the stop 18 is retracted and the entire length L of the table is employed in a single mode operation. However, when handling shorter product lengths, both of the table stops 16 and 18 can be employed alternatively in a dual mode operation to arrest batches for lateral transfer to positions 24 and 30. Additional table stops could of course be added under appropriate circumstances.

Each batch of cut product lengths is carried by the delivery chains 22 to rotatably driven truncated conical separating rollers indicated typically at 32. The rollers 32 separate the product lengths 12 of a given batch and deliver them in the direction of arrow 34 into an alignment zone "Z" which extends longitudinally between locations A and B. The end alignment apparatus of the present invention, which is generally indicated at 36, is located at the alignment zone Z.

Figure 3:
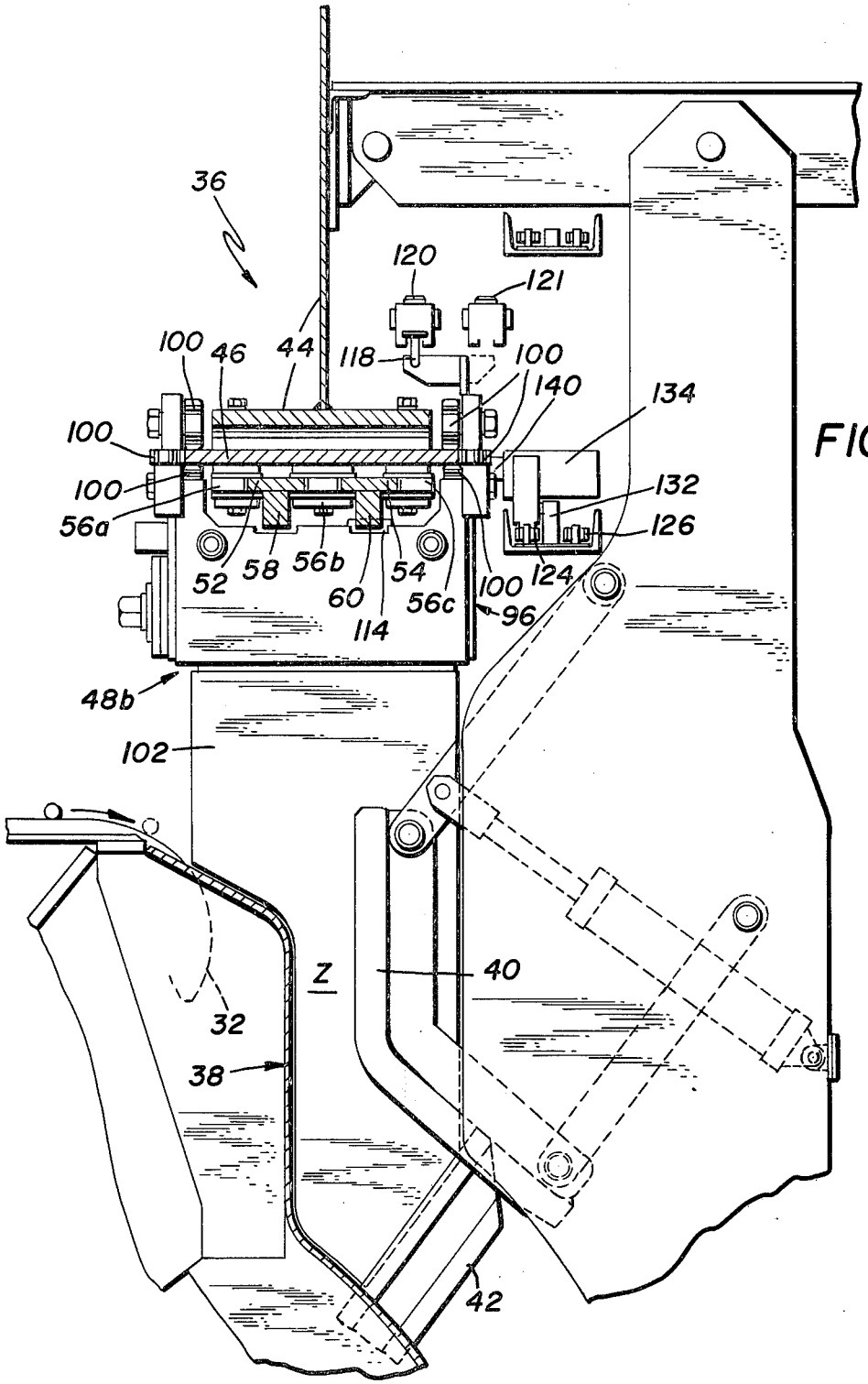
FIG. 3 is a sectional view on a greatly enlarged scale taken along lines 3—3 of FIGS. 1 and 2.

As can be best seen in FIG. 3, in the embodiment being herein employed for illustrative purposes, the alignment zone Z is formed on one side by curved apron plates 38, and on the opposite sides by the edges of pivotably adjustable gags 40. The bottom of the zone is formed by pivotal assembly arms 42 which are gradually lowered as product lengths are accumulated thereon. When a full bundle quantity of bars has been accumulated, the assembly arms 42 are lowered still further to deposit the bars on an underlying transfer carriage (not shown) which can be of any known design.

Figure 2:
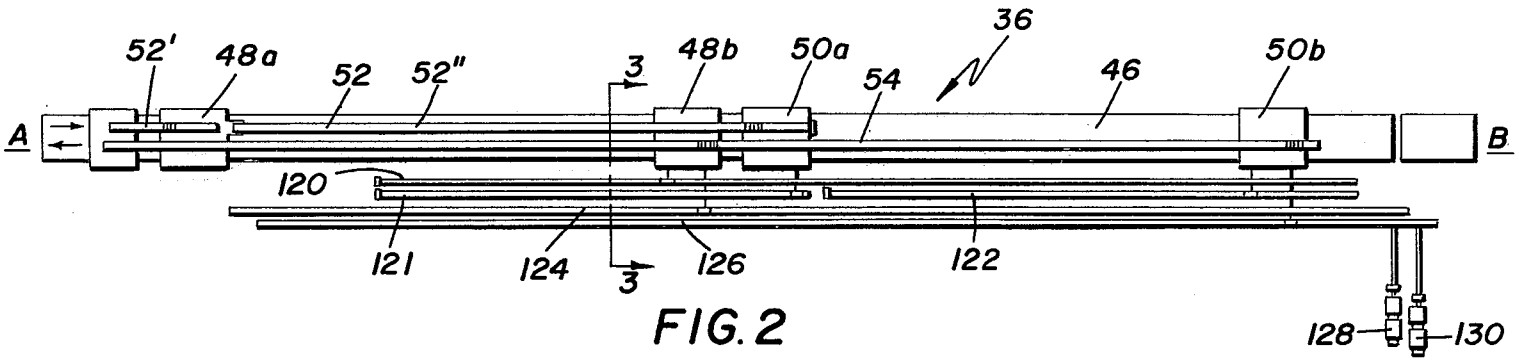
FIG. 2 is another schematic plan view showing the relationship of the principle components of the end alignment apparatus of the present invention.

The end alignment apparatus 36 of the present invention operates to align the ends of cut product lengths as they enter the alignment zone Z. Referring now to FIGS. 1–3, it will be seen that the end alignment apparatus 36 includes a stationary longitudinally extending support frame 44 proximate to and spanning the length of the alignment zone Z. An elongated rail 46 is fixed to the support frame 44. In the illustrated embodiment, which is designed for either single or dual mode operation, two pairs 48, 50 of alignment heads are mounted on the rail 46 for movement along the length thereof. One of the pairs 48 of alignment heads includes a "first" head 48*a* and a "second" head 48*b*. The other pair 50 likewise includes a "first" head 50*a* and a "second" head 50*b*.

The support frame 44 also carries two longitudinally extending draw bars 52 and 54. The draw bars are mounted between guides 56*a*, 56*b* and 56*c* for reciprocal axial movement relative to the support frame 44 and the rail 46 fixed thereto. As is best shown in FIG. 2, the draw bar 54 spans substantially the entire length of the alignment zone Z. By comparison, the draw bar 52 is much shorter in length, with one section 52′ extending from location A to the first alignment head 48*a*, and another section 52″ extending from the first alignment head 48*a* to approximately the middle of the alignment zone. The draw bars 52 and 54 are respectively provided on their undersides with toothed racks 58 and 60, the purpose of which will presently be described in more detail.

Figure 8:
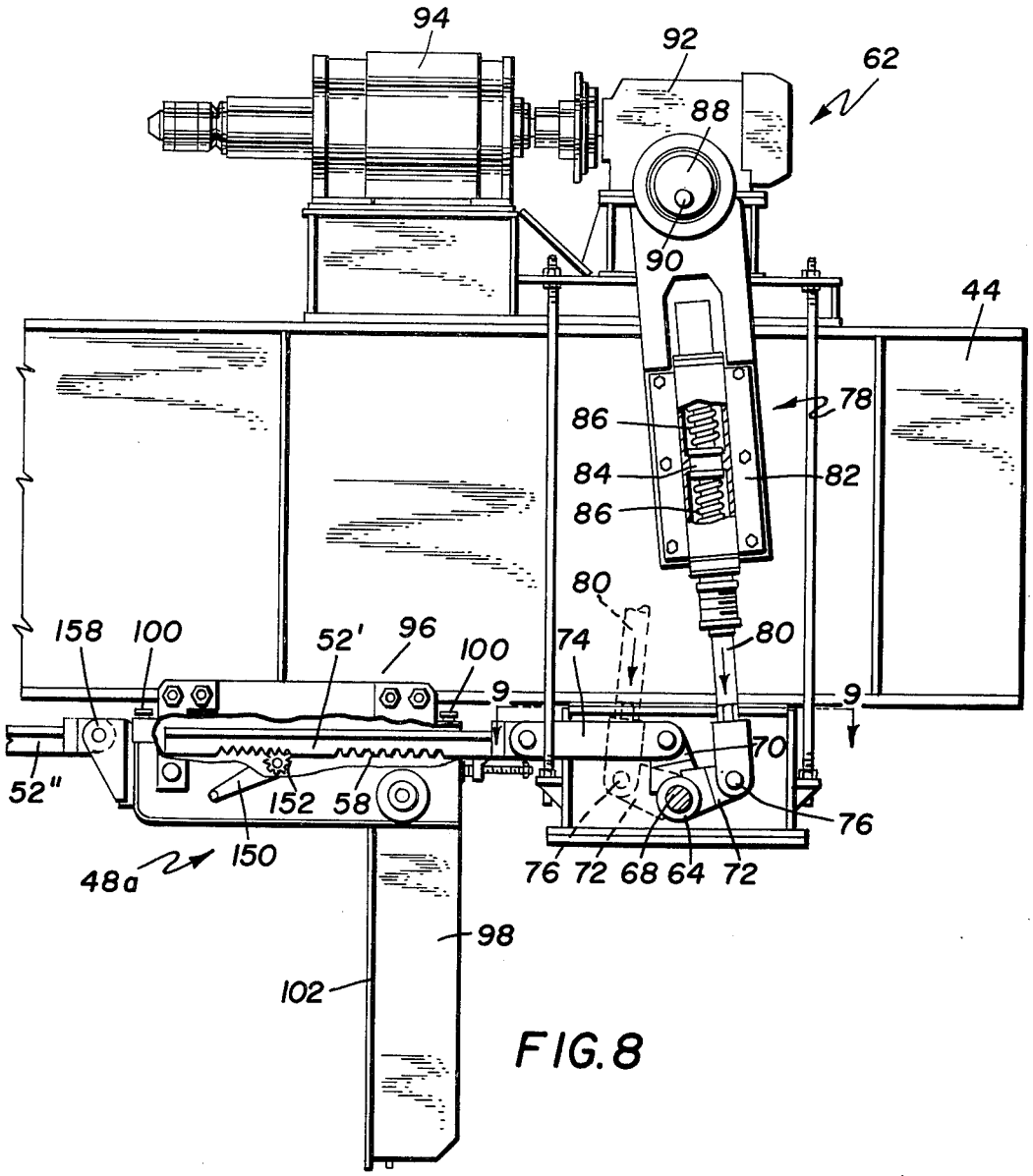
FIG. 8 is another side view taken along lines 8—8 of FIG. 1.
Figure 9:
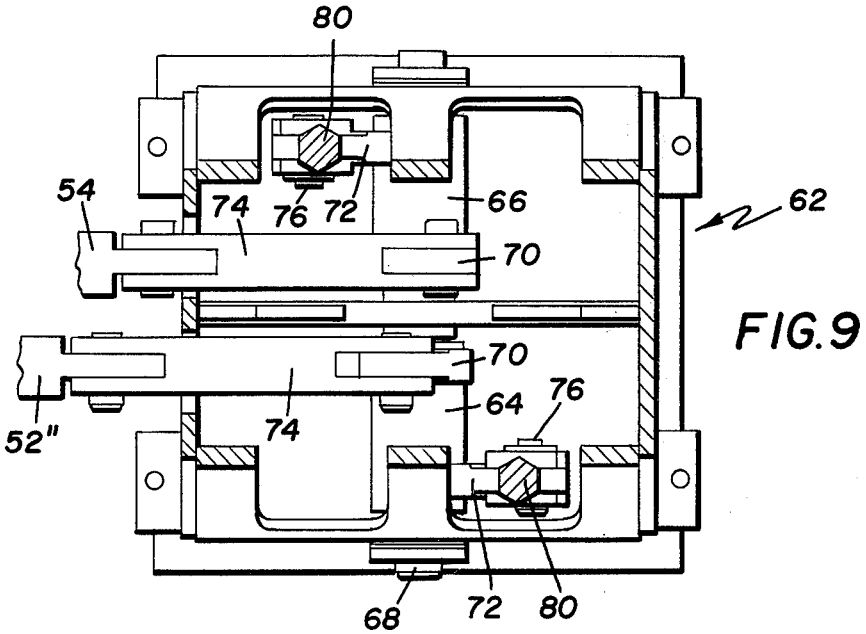
FIG. 9 is a sectional view taken along lines 9—9 of FIG. 8.

The draw bars 52 and 54 are reciprocally driven by a drive means generally indicated at 62. With reference to FIGS. 8 and 9, it will be seen that the drive means 62 includes a pair of crank members 64 and 66 mounted for independent rotation about an axle 68 which extend transversally to the lengths of the draw bars. Each of the crank members has two radial arms 70 and 72. The arms 70 of crank members 64 and 66 are connected respectively by intermediate links 74 to the shorter section 52″ of draw bar 52 and to the end of draw bar 54. The other arms 72 of the crank members 64, 66 are connected as at 76 to the lower ends of intermediate connecting members generally indicated at 78. Each intermediate connecting member 78 is made up of a rod 80 which is axially received in an upper section 82. The rod 80 has a central collar 84 acted upon by opposed springs 86.

Each of the upper sections 82 has an eccentric 88 journalled for rotation therein. The eccentrics 88 are keyed to a shaft 90 which is parallel to the axle 68. Shaft 90 is driven through a gear reducer 92 by a motor 94. When the shaft 90 and its eccentrics 88 are rotated, the connecting members 78 are simultaneously reciprocated in the same direction, and this reciprocal motion is transmitted through the crank members 64 and 66 to cause the draw bars 52 and 54 to reciprocate simultaneously in opposite directions.

With reference now to FIGS. 3 to 8 and 10A, 10B, it will be seen that the alignment heads 48*a*, 48*b*, 50*a* and 50*b* are in many respects quite similar in construction. For example, each has an upper carriage section 96 with a leg 98 depending therefrom. The upper carriage sections have appropriately positioned guide wheels 100 which run along the outer edges of the rail 46. The legs 98 have product contacting surfaces 102 which as can be seen in FIG. 3 are shaped to conform generally to the profile shape of the alignment zone Z. The product contacting surfaces of the first alignment heads 48*a* and 50*a* are of course the mirror images of the contacting surfaces on the second alignment heads 48*b*, 50*b*.

Remotely operable locking means are employed to releasably engage the first alignment heads 48*a*, 50*a* to draw bar 52, and the second alignment heads, 48*b*, 50*b* to the draw bar 54.

Figure 4A:
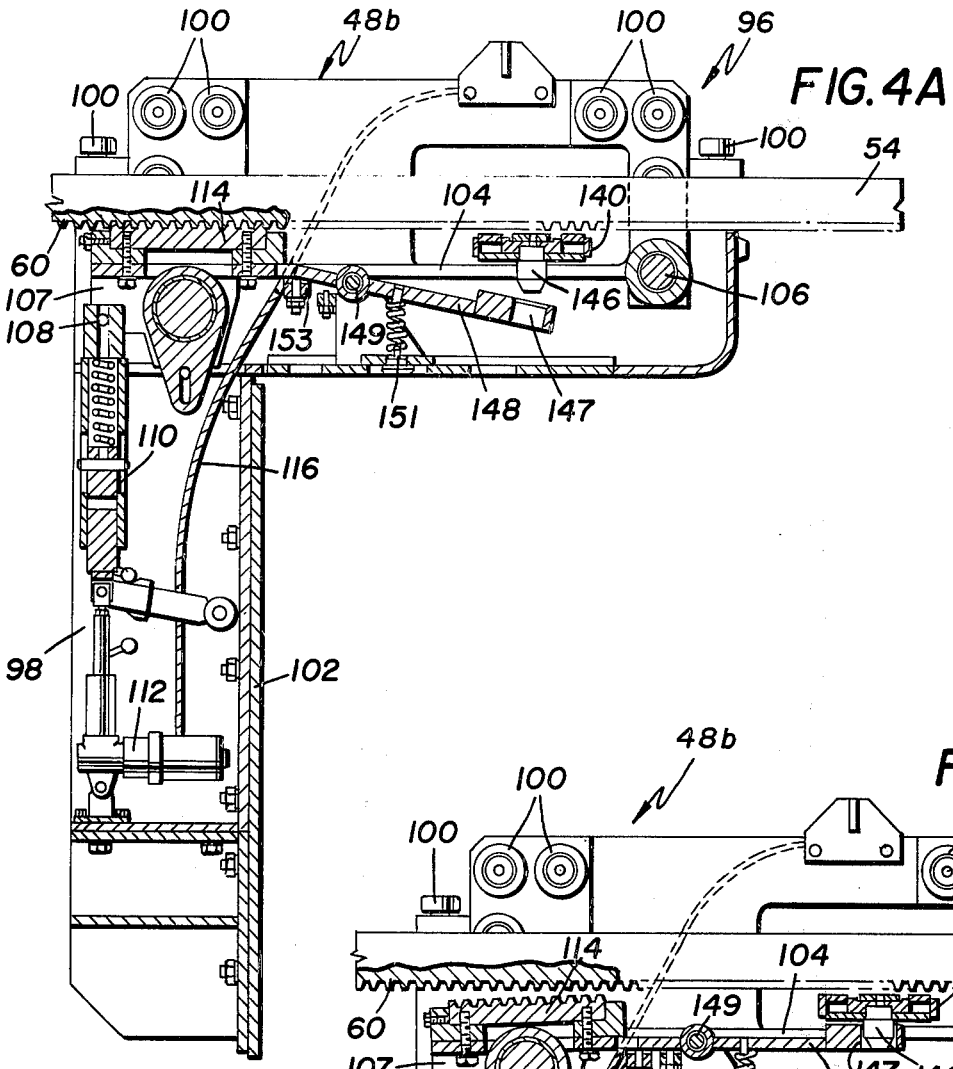
FIGS. 4A and 4B are side views of the apparatus shown in FIG. 3 looking from left to right with portions of the alignment head in section.
Figure 4B:
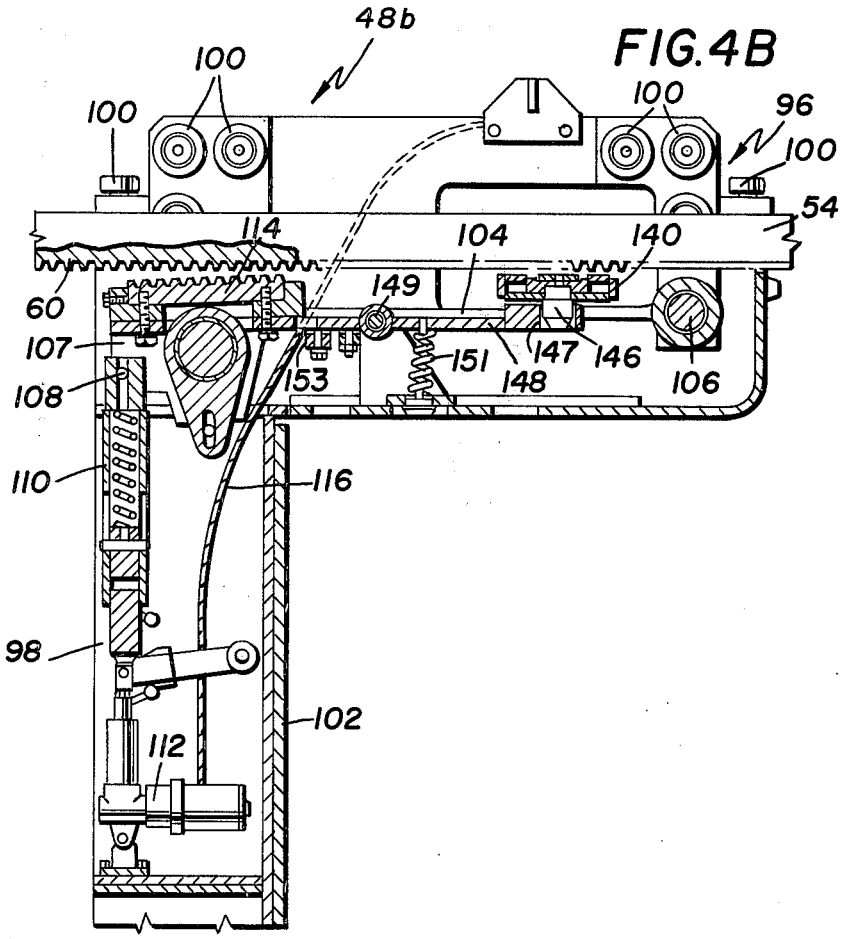
Figure 5:
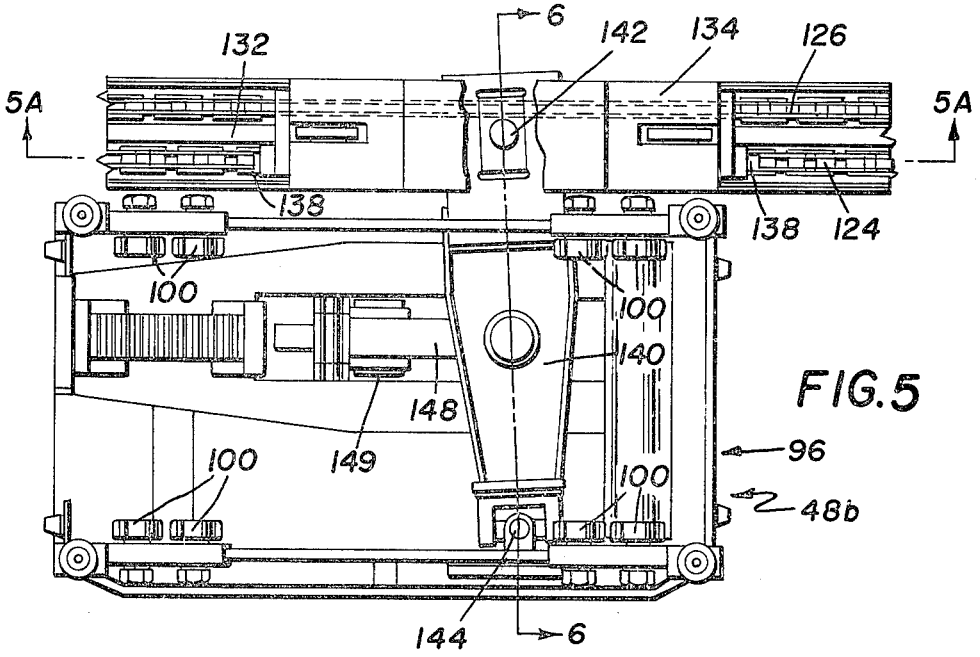
FIG. 5 is a plan view of the alignment head shown in FIG. 3.
Figure 6:
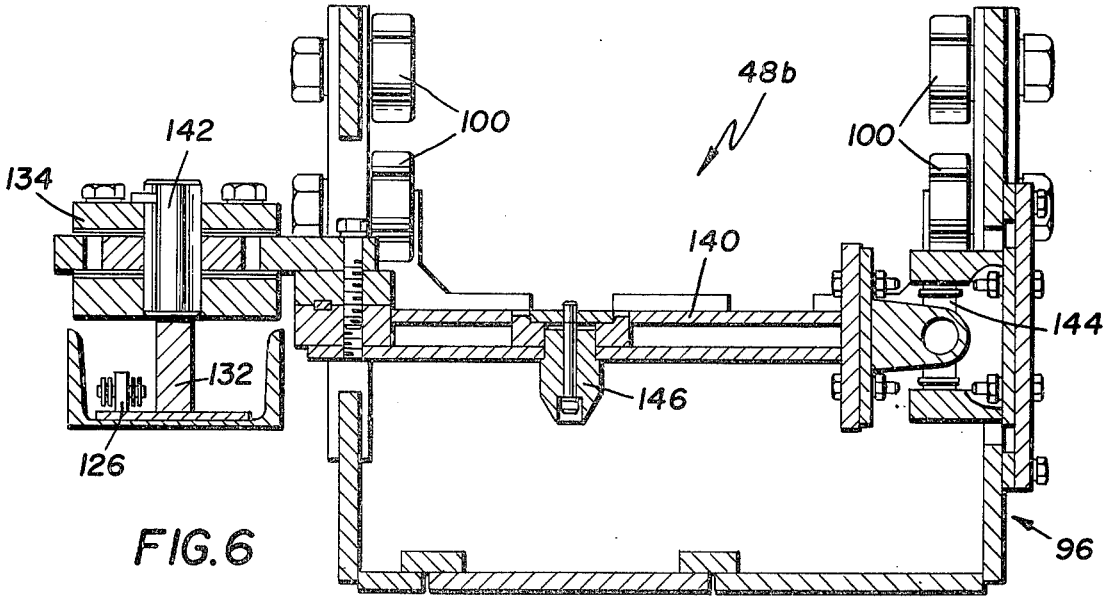
FIG. 6 is a sectional view taken along line 6—6 of FIG. 5.

The second alignment heads 48*b* and 50*b* are substantially identical in construction, and hence a description of their locking means can be had with reference to FIGS. 3, 4A and 4B. Each of the second alignment heads 48*b* and 50*b* has a locking lever 104 which is mounted at one end for pivotal motion about a transverse shaft 106 supported by the carriage assembly 96. The locking lever has a depending plate 107 which is connected as at 108 to a spring-loaded push rod 110. Rod 110 is operated by an electrically powered screw jack 112. A short toothed rack segment 114 is secured to the upper side of the locking lever 104. By operating the screw jack 112 to raise the push rod 110, the rack segment 114 on the locking lever 104 is pivoted upwardly into engagement with the rack 60 on draw bar 54, thereby locking the alignment head to the bar. Reverse operation of screw jack 112 disengages the rack 114 from the rack 60 as shown in FIG. 4B, thereby freeing the alignment head for movement relative to the draw bar 54 along rail 46.

Figure 7:
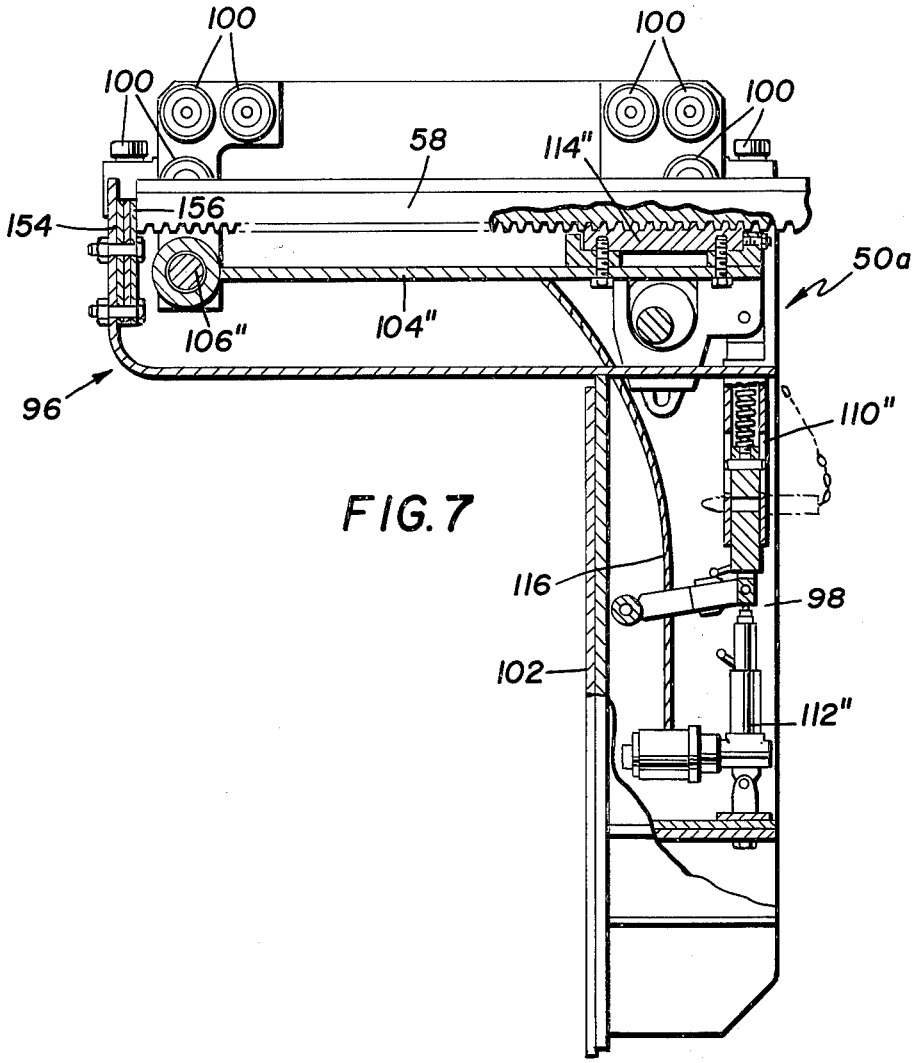
FIG. 7 is a side view taken along lines 7—7 of FIG. 1 with portions of the alignment head shown in section.

The first alignment heads 48*a*, 50*a* have similar locking mechanisms which cooperate with the rack 58 on the underside of draw bar 52. More particularly, as shown in FIG. 10B, the first alignment head 48*a* has a locking lever 104′ pivoted at 106′ and carrying a rack segment 114′. The lever 104′ is manipulated by a spring loaded push rod and screw jack (not shown) in the depending leg 98. Similarly, as shown in FIG. 7, the first alignment head 50*a* also has a locking lever 104″ pivoted at 106″ and carrying a rack segment 114″. The lever 104″ is manipulated by a spring loaded push rod 110″ and a screw jack 112″.

Electric power for the screw jacks 112 on the alignment heads 48*b*, 50*a* and 50*b* is provided through flexible conduits 116 connected to trolleys 118 (see FIG. 3) arranged to run in one of three energized ducts 120, 121 and 122. As schematically shown in FIG. 2, the trolley 118 of alignment head 48*b* runs in duct 120, while the trolleys 118 of alignment heads 50*a* and 50*b* run respectively in ducts 121 and 122. The trolleys 118 and ducts 120, 121 and 122 are known commercially available products. For example, the trolleys can be Model No. T331 or T-131 and the ducts can be a TROL-E-DUCT, both being products supplied by ITE Imperial Corporation of Spartanburg, S.C., U.S.A. With this arrangement, the screw jacks 112 of the alignment heads 48*b*, 50*a* and 50*b* can be operated remotely from a central control location.

Figure 5A:
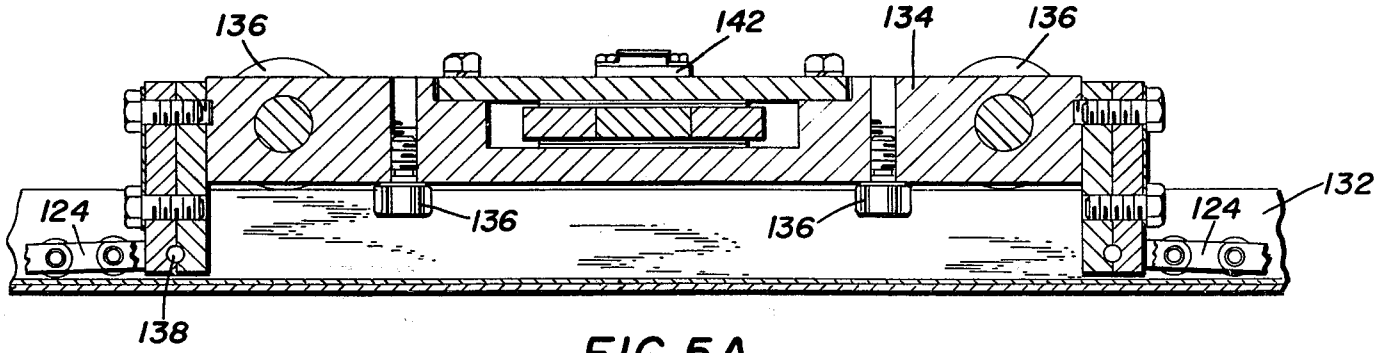
FIG. 5A is a sectional view taken along lines 5A—5A of FIG. 5.

A remotely operable positioning means is connected to the second alignment heads 48*b* and 50*b*. With reference to FIGS. 2–6, the positioning means includes two drive chains 124 and 126 which extend longitudinally in parallel relationship with the rail 46. As is schematically shown in FIG. 2, one chain 124 is connected to alignment head 48*b* and the other chain 126 is connected to alignment head 50*b*. The chains are separately driven by motors 128 and 130. The means employed to connect each alignment head to its associated chain includes a second rail 132 parallel to rail 46. A trolley 134 having appropriately positioned guide wheels 136 (see FIG. 5A) is arranged to run on the rail 132. The trolleys 134 are connected at opposite ends as at 138 to one of the chains 124 or 126. An arm member 140 is pivotally connected at one end to the trolley 134 at 142 and extends laterally therefrom into the upper carriage section 96 of the alignment head. The other end of the arm member 140 is pivotally connected to the alignment head at 144. The arm member 140 has a depending pin 146 at its approximate mid-section. The pin 146 is arranged to be received in an eye 147 located in one end of a connecting lever 148 which is pivotally mounted on the carriage assembly 96 as at 149 (see FIGS. 4A and 4B). The connecting lever 148 is acted upon by a compression spring 151, and is engageable by a cross-member 153 on the locking lever 104. When the locking lever 104 is pivoted upwardly to place the rack segment 114 in engagement with the rack 60 on draw bar 54, the cross-member 153 engages the connecting lever 148, causing the lever to pivot in a clockwise direction as viewed in FIG. 4A, with the result that eye 147 is retracted from the pin 146 on the arm member 140. When the locking lever 104 is pivoted in the opposite direction to disengage rack segment 114 from rack 60, the compression spring 151 urges the connecting lever 148 in a counterclockwise direction, bringing the eye 147 into engagement with pin 146. When as shown in FIG. 4A the pin 146 is disengaged from the eye 147 in the connecting lever 148, the arm member 140 is free to pivot at its opposite ends as at 142, 144 thereby allowing the alignment head to reciprocate back and forth on the rail 46 under the influence of the reciprocating draw bar 60 while the positioning chains 124, 126 remain stationary. However, as shown in FIG. 4B, when the connecting lever 148 is pivoted to disengage the rack segment 114 from rack 60, the pin 146 is received in eye 147, thereby providing a rigid connection between the alignment head and its associated trolley 134, which thus allows the alignment head to be precisely moved along the rail 46 by its associated drive chain.

Figure 10A:
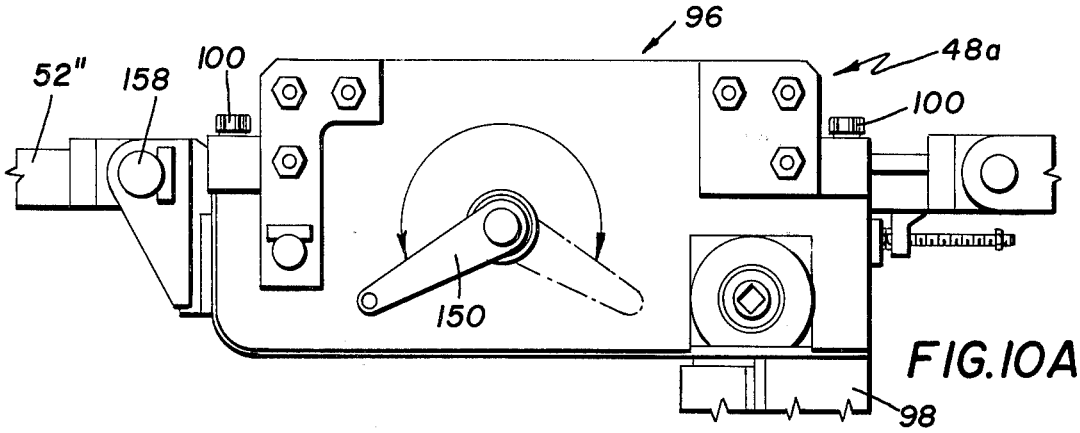
FIGS. 10A and 10B are enlarged side views of the upper portion of the alignment head shown in FIG. 8; and, FIGS. 11A and 11B are schematic illustrations showing the apparatus adjusted for either dual or single mode operation.
Figure 10B:
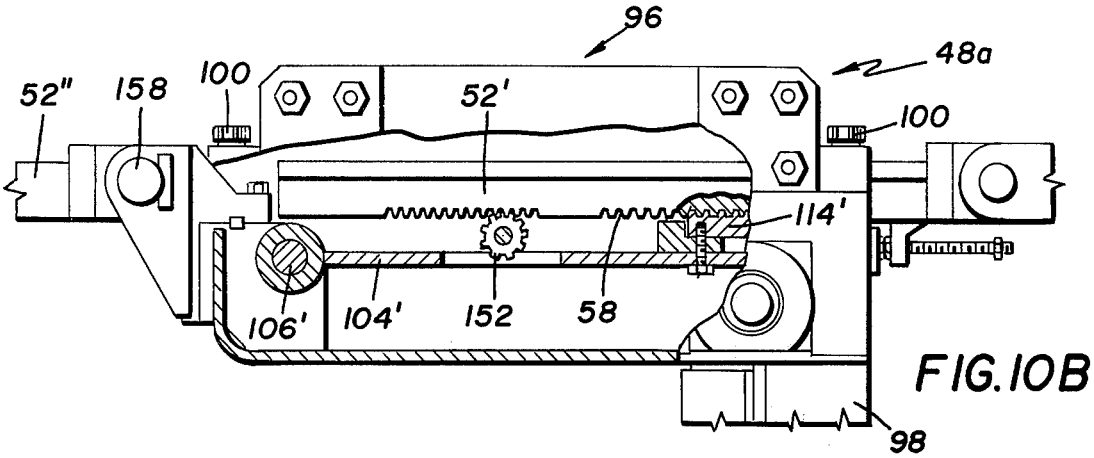

With reference to FIGS. 8, 10A and 10B, it will be seen that the first alignment head 48*a* is movable manually in relation to the short section 52′ of draw bar 52 through only a short distance by rotating handle 150 to turn pinion 152, the latter being in constant meshed relationship with rack 58. This limited manual adjustment is provided to compensate for adjustments made to the table stops 16 and 18 as previously described.

With further reference to FIG. 7, it will be seen that the first alignment head 50*a* is located relative to draw bar 58 by a stop 154 which engages the end of the bar 58 at 156. Neither of the first alignment heads 48*a* and 50*a* are connected to the drive chains 124 and 126.

Having thus described the principal components which comprise the apparatus of the present invention, its operation will now be reviewed. When initially setting up the apparatus for either single or dual mode operation, the cooperating pairs of first and second alignment heads are stopped in the position where they are closest to one another. This can be accomplished by stopping the drive means 62 in response to signals received from appropriately positioned limit switches engaged by the draw bars 52, 54. Thereafter, the position of the first alignment head 48*a* is checked with reference to the position of the table stop 16. If the table stop has been shifted, for example to location 16′ (see FIG. 1), then alignment head 48*a* will be correspondingly shifted by disengaging its locking means and manually turning handle 150. Any adjustment to the first alignment head 48*a* will also be transmitted to the longer section 52″ of the draw bar 52 and to the first alignment head 50*a* when it is connected thereto due to the fact that the draw bar section 52″ is connected to the first alignment head 48*a* as at 158 (see FIGS. 8, 10A, 10B). Once this has been accomplished, the other alignment heads are positioned for either single or dual mode operation, depending on the length of the product sections 12 being received on roller table 11.

Figure 11A:
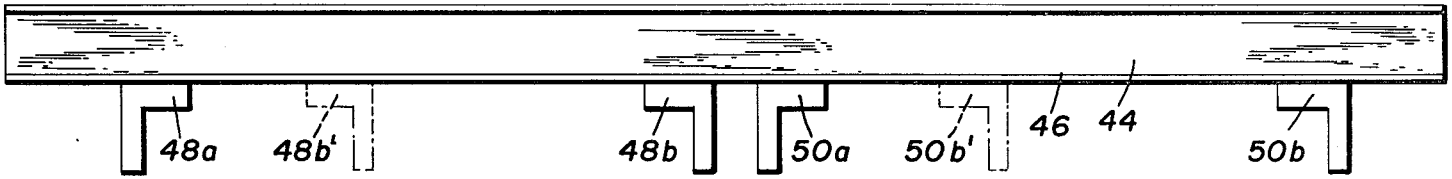

For example, and with reference to FIG. 11A, if a dual mode of operation is contemplated, it will probably be necessary to adjust the spacing between the cooperating pairs of first and second alignment heads 48*a*, 48*b* and 50*a*, 50*b*. This will be accomplished in the following manner: the ducts 120 and 122 will be energized to disengage the locking mechanisms of the second alignment heads 48*b*, 50*b*, thereby freeing the second alignment heads for movement relative to draw bar 54 along rail 46. Thereafter, the drive chains 124, 126 will be operated to move the heads 48*b*, 50*b* to the desired location. The maximum range of any such adjustment is shown by the dotted representations at 48*b'* and 50*b'* in FIG. 11. When the second alignment heads 48*b* and 50*b* are properly located, the drive chains 124, 126 are stopped and the ducts 120, 122 are energized to engage the locking mechanisms to again connect the second alignment heads 48*b*, 50*b* to the draw bar 54. The apparatus is then ready for dual mode operation.

Figure 11B:
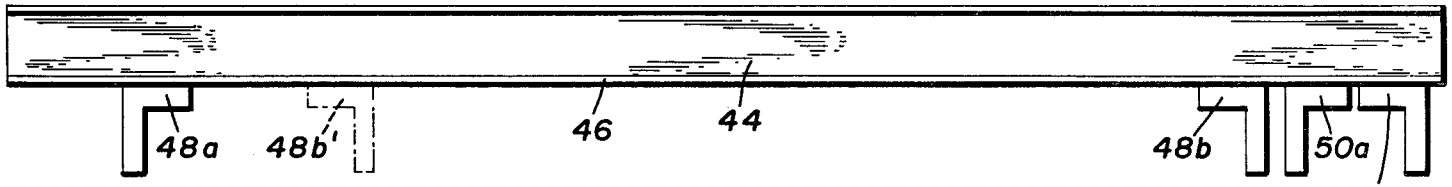

With reference to FIG. 11B, when converting the apparatus to single mode operation, the following steps are taken: the ducts 120, 121 and 122 are energized to disengage the locking mechanisms of alignment heads 48*b*, 50*a* and 50*b*. Thereafter, the drive chain 126 is employed to move second alignment head 50*b* to a remote inoperative position at the end of rail 46. The drive chain 124 is likewise employed to move second alignment head 48*b* to the right as viewed in FIG. 11B, with the result that the first alignment head 50*a* is contacted by head 48*b* and also moved to a remote inoperative position at the end of the rail 46. Once this has been accomplished, the position of the second alignment head is adjusted with reference to alignment head 48*a*, after which the duct 120 is energized to lock the head 48*b* to its draw bar 54. The apparatus is then ready for single mode operation. As shown in FIG. 11B, the minimum product length that can be handled during single mode operation is defined by the space between first alignment head 48*a* and the second alignment head when the latter is located at 48*b'*.

In light of the foregoing, it will thus be seen that the present apparatus is ideally suited to handle the wide range of product lengths produced by modern high speed bar mills. Conversion between single and dual mode operation can be accomplished quickly and remotely through the use of locking mechanisms powered by the ducts 120, 121 and 122 operating in conjunction with the separately driven positioning chains 124, 126.

Should an oversized product length be inadvertently directed to the apparatus, the springs 86 forming part of the drive means 62 (see FIG. 8) will act as resilient safety devices which will prevent the alignment heads from being damaged.

It is my intention to cover all changes and modifications to the embodiment herein chosen for purposes of disclosure which do not depart from the spirit and scope of the invention.

I claim:

1. Apparatus for aligning the ends of product lengths delivered laterally into a longitudinally extending alignment zone, said apparatus comprising:

a stationary support frame located proximate to said alignment zone;

elongated rail means fixed to said support frame, said rail means extending in a direction parallel to the length of said alignment zone;

a plurality of pairs of first and second alignment heads carried on said rail means for movement along the length thereof, each of said alignment heads having a product contacting surface extending into said alignment zone;

two draw bars carried on said support frame;

drive means for axially reciprocating said draw bars simultaneously in opposite directions relative to said support frame;

locking means for connecting said draw bars to said alignment heads, the locking means associated with said first alignment heads being releasably engageable with one of said draw bars and the locking means associated with said second alignment heads being releasably engageable with the other of said draw bars;

and positioning means for adjusting the distance between cooperating pairs of said alignment heads by moving said alignment heads along said rail means relative to said draw bars.

2. The apparatus as claimed in claim 1 wherein said drive means is comprised of a pair of crank members mounted for independent rotation about an axis extending transversally to the lengths of said draw bars, each of said crank members having two radial arms, one of the arms on each crank member being connected to one of said draw bars, the other of the arms on each crank member being connected to an operating means for simultaneously reciprocating said crank members in opposite directions about said axis.

3. The apparatus as claimed in claim 2 wherein said operating means is comprised of a rotatable shaft parallel to said axis, a pair of eccentric members fixed to said shaft for rotation therewith, and intermediate connecting members, each said connecting members being pivotally attached at one end to the other arm of one of said crank members and having one of said eccentric members journalled for rotation at the opposite end thereof.

4. The apparatus as claimed in claim 3 wherein each of said intermediate connecting members is comprised of an assembly of axially movable spring loaded components.

5. The apparatus as claimed in claim 1 wherein said locking means is comprised of first rack means on said draw bars, and second rack means on said alignment heads, said second rack means being mounted for movement into and out of engagement with said first rack means.

6. The apparatus as claimed in claim 1 wherein said positioning means is comprised of a drive chain associated with each pair of said alignment heads, said drive chains extending in parallel relationship with said rail means, means for driving said drive chains independently of each other, and connecting means for connecting the second alignment head of each of said pairs of alignment heads with one of said drive chains.

7. The apparatus as claimed in claim 6 wherein said connecting means includes a second rail means parallel to said first mentioned rail means; trolley means connected to said drive chains and mounted on said second rail means for movement along the length thereof, and arm members extending between and pivotally connected to said trolley means and said second alignment heads.

8. The apparatus as claimed in claim 7 wherein the locking means associated with said second alignment heads is comprised of a first rack means on said draw bars, pivotal locking levers on said second alignment heads, second rack means on said locking levers, interlocking means on said locking levers for engaging said arm members, and operating means for pivotally manipulating said locking levers between a first position at which said first and second rack means are in engagement with said interlocking means out of engagement with said arm members, and a second position at which said first and second rack means are disengaged and said interlocking means is in engagement with said arm members.

9. The apparatus as claimed in claim 8 wherein said operating means is electrically powered through means in slidable contact with an energized duct means which is parallel to said first and second rail means.

10. Apparatus for aligning the ends of product lengths delivered laterally into a longitudinally extending alignment zone, said apparatus comprising:

a stationary support frame located proximate to said alignment zone;

an elongated rail means fixed to said support frame and extending in a direction parallel to the length of said alignment zone;

a plurality of pairs of first and second alignment heads carried on said rail means for movement along the length thereof, each of said alignment heads having a product contacting surface extending into said alignment zone;

two draw bars carried on said support frame;

drive means for axially reciprocating said draw bars simultaneously in opposite directions relative to said support frame;

locking means for establishing a drive connection between said draw bars and said alignment heads, said locking means including first rack means on said draw bars and second rack means mounted on said alignment heads for movement into and out of engagement with said first rack means; and, positioning means for adjusting the distance between cooperating pairs of said alignment heads by moving said alignment heads along said rail means, said positioning means including a drive chain associated with each pair of said alignment heads, said drive chains extending in parallel relationship with said rail means, means for driving said drive chains independently of each other, and connecting means for connecting the second alignment head of each of said pairs of alignment heads with one of said drive chains.

* * * * *